United States Patent [19]

Haytayan

[11] 4,452,387

[45] Jun. 5, 1984

[54] SELF-CENTERING FASTENING TOOL

[75] Inventor: Harry M. Haytayan, Lincoln, Mass.

[73] Assignee: Pneutek, Inc., Hudson, N.H.

[21] Appl. No.: 368,658

[22] Filed: Apr. 15, 1982

[51] Int. Cl.[3] ..... B25C 1/04

[52] U.S. Cl. ..... 227/8; 227/130; 227/151

[58] Field of Search ..... 227/8, 120, 130, 151

[56] References Cited

U.S. PATENT DOCUMENTS

| | | | |
|---|---|---|---|
| 2,588,738 | 3/1952 | Lundgren | 227/151 X |
| 2,637,030 | 5/1953 | Wickman et al. | 227/151 |
| 2,946,060 | 7/1960 | Powers | 227/151 X |
| 3,283,986 | 11/1966 | McKee | 227/120 |
| 3,711,008 | 1/1973 | Clifford et al. | 227/130 X |
| 4,227,637 | 10/1980 | Haytayan | 227/130 X |

*Primary Examiner*—Paul A. Bell

*Attorney, Agent, or Firm*—Schiller & Pandiscio

[57] ABSTRACT

Self-centering fastening tool for quickly and easily fastening wire and paper lath to support members.

8 Claims, 4 Drawing Figures

SELF-CENTERING FASTENING TOOL

FIELD OF THE INVENTION

This invention relates to pneumatic tools in general, and more particularly to pneumatic driving tools of the sort used to set fasteners into a workpiece.

BACKGROUND OF THE INVENTION

In order to form a plaster facing for a wall or ceiling, it is necessary that there first be a substantially continuous surface or "base" to which the plaster can be applied and to which it will cling.

Where the plaster facing is to be applied directly to a continuous concrete or masonry surface, the masonry or concrete surface itself may serve as the plaster base. Where, however, the plaster facing is to be formed about relatively sparsely spaced structural members such as studs, furring strips, or joists, some sort of base material must first be attached to the structural members to bridge the spaces between the structural members and provide the substantially continuous surface to which the plaster can be applied. Bridging material of this kind is generally called lath. Lath formerly consisted of a plurality of thin wooden strips which were nailed at right angles to the structural members. Narrow openings were left between adjacent wooden strips, in order that some of the plaster being applied could penetrate through the openings to form "keys" which then bonded the plaster to the lath.

In modern plastering, wooden laths have been almost entirely superceded by various types of gypsum and metal laths. One particular type of lath now in common use comprises a wire grid which may have a multi-layered backing of heavy paper interwoven with the grid. This lath is fastened to the structural members (i.e. the studs, furring strips, or joists), which define where the plaster facing is to be disposed and then a layer of plaster is applied to the lath. The plaster penetrates in between the intersecting wires, and in between any layers of heavy paper attached to the wires, so as to form the keys which then bind the plaster to the lath.

Unfortunately, attaching the wire lath to the structural members can be quite time consuming for a number of reasons.

First, the attachment must be effected with large numbers of fasteners which have significant holding power, in order that the weight of the plaster being applied to the lath will not cause the lath to pull away from the structural members once the plaster has been applied. Where the structural members are of the type which will receive and grip a standard nail, e.g., where the structural members are formed out of wood, nailing is the preferred from of attachment. However, setting large numbers of nails by hand is a tedious and tiring task. In addition, where the structural members are of the type which will not receive and grip a standard nail, e.g., where the structural members comprise steel channel members fabricated out of thin metal sheet stock, special headed pins having shanks with pointed tips and helical threads must be used. However, setting large numbers of these threaded pins by hand is an especially tedious and tiring task.

In addition, a preferred method of attachment involves captivating the wire intersections of the lath between the head of the fastener and the structural member receiving the fastener. Such captivation is felt to result in superior attachment of the lath to the structural members. However, this attachment technique tends to be time consuming since the fasteners must be precisely positioned relative to the lath during setting.

OBJECTS OF THE PRESENT INVENTION

As a result, the principal object of the present invention is to provide a fastening tool which will facilitate the attachment of wire and paper lath to structural members such as studding, furring strips or joists.

Another object is to provide a fastening tool which will fasten wire-type lath to structural members by captivating the lath's wire intersections between the head of a fastener and the structural member.

Yet another object is to provide a fastening tool which includes means thereon for quickly and easily centering the tool about one of the wire intersections of a wire and paper lath, in order that a fastener fired by the tool can consistently capture the wire intersection between the head of the fastener and the structural member receiving the fastener.

Still another object is to provide a fastening tool which operates in accordance with the principles of the tool disclosed in U.S. Pat. No. 4,040,554, and which operates with fasteners comprising a standard nail or with fasteners comprising a headed pin with a threaded shank.

Yet another object is to provide a fastening tool which is light in weight, low in cost, fast in operation, and effective in practice.

SUMMARY OF THE INVENTION

These and other objects of the present invention are achieved by providing a fastening tool which generally comprises a fastener driver and centering means coupled to the fastener driver. The fastener driver can be any one of numerous drivers well known in the art, though preferably it is a pneumatic driver of the sort shown in U.S. Pat. No. 4,040,554. The centering means comprises at least one groove disposed on the front portion of the fastening tool. The at least one groove is adapted to receive at least one wire of a wire and paper lath when the fastening tool is pressed against the lath, in order that the at least one groove may serve to facilitate centering the fastening tool about at least one wire of the lath. In the preferred form of the invention, the centering means comprises a pair of intersecting grooves disposed on the fastening tool and adapted to facilitate centering the fastening tool about a wire intersection of the lath. The at least one groove may be on the exit nozzle of the fastener driver. Alternatively, and more preferably, however, the at least one groove is disposed on the front side of a centering block which is positioned in front of the exit nozzle of the fastener driver so that the block is in the path of a fastener leaving the fastener driver. A bore is provided in the block so that a fastener can pass through the block. The at least one groove is disposed relative to the bore so that when the centering block is centered about at least one wire a fastener fired by the driver can fasten the at least one wire to a structural member with the head of the fastener. In the case where the centering means comprises a pair of intersecting grooves, the grooves are disposed relative to the bore so that when the centering block is centered about a wire intersection, a fastener fired by the driver can fasten the wire intersection to a structural member with the head of the fastener.

BRIEF DESCRIPTION OF THE DRAWINGS

Still other objects and features of the invention will be disclosed or rendered obvious in the following detailed description of the preferred embodiment, which is to be considered together with the accompanying drawings wherein like numbers refer to like parts and further wherein.

DETAILED DESCRIPTION OF THE PREFERRED EMBODIMENT

Figure 1:
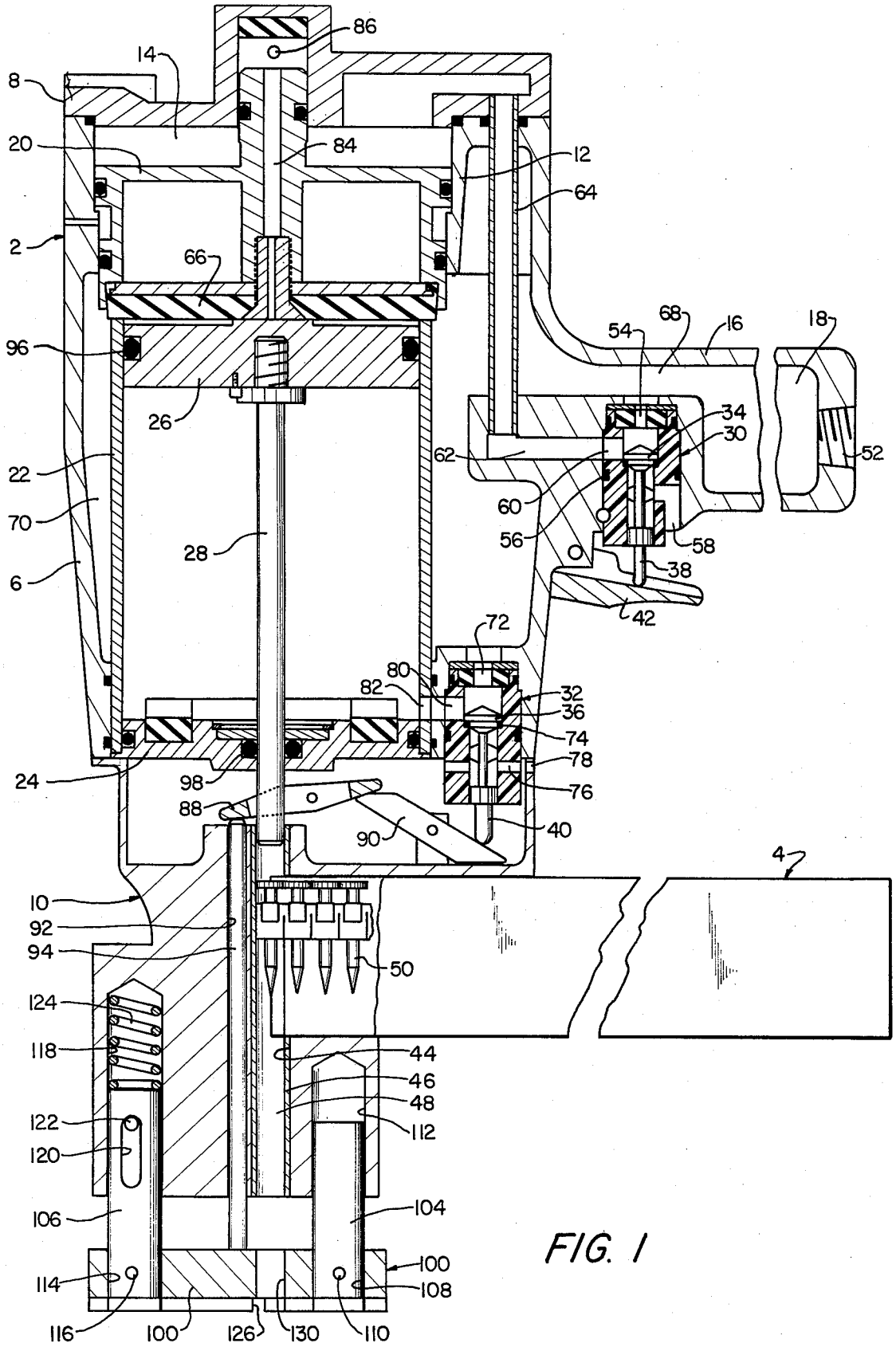
FIG. 1 is a side view in section of the preferred form of fastening tool, shown with its hammer in a retracted position and its centering block in an extended position.

Referring first to FIG. 1, the fastening tool generally comprises a pneumatic driver 2 for driving a fastener supplied by a fastener magazine 4, and a centering block 100 for assuring that the tool is properly disposed about one of the wire intersections of the wire and paper lath when a fastener is fired.

The pneumatic driver 2 and the fastener magazine 4 are substantially the same as disclosed in U.S. Pat. No. 4,040,554 except that the nozzle of driver 2 has been modified to incorporate the centering block 100 made in accordance with the present invention. Accordingly, driver 2 and magazine 4 are described herein only to the extent believed necessary to understand and appreciate the present invention.

Still referring to FIG. 1, driver 2 generally comprises an outer housing 6 which has its upper and lower ends closed off by a cap member 8 and a nozzle 10 respectively. Housing 6 is formed so that one portion 12 coacts with cap 8 to define a poppet valve casing providing a chamber 14, and another portion 16 serves as a handle and also defines a manifold chamber 18. Housing 6 accommodates a poppet valve 20, a cylinder 22 closed off by an end wall 24, a piston 26 slidably disposed within cylinder 22, a hammer 28 attached to the piston and slidably extending through an opening in end wall 24, a control valve 30, and a safety valve 32. Valves 30 and 32 comprise valve members 34 and 36 attached to actuating rods 38 and 40 respectively, and a trigger 42 pivotally attached to housing 6 serves as a means for causing rod 38 to move valve member 34.

Fastener magazine 4 is mounted to nozzle 10. Nozzle 10 is formed with a bore 44 provided with a liner 46 and the lower end of hammer 28 extends into the hammer travelway 48 defined by the liner. Nozzle 10 is adapted to permit fasteners 50 to be admitted in single file into the hammer travelway 48.

Other parts of the driver are described in connection with the following description of how it operates. First, pressurized air is supplied to manifold chamber 18 by connecting its inlet port 52 to a suitable supply of pressurized air, e.g., air at 80–160 psig. This air passes through an orifice 54 of valve 30 and acts on the valve head 34 to close off an opening defined by a valve seat 56 leading to a vent passageway 58. As a consequence, the air passing through orifice 54 proceeds out of valve 30 via a side port 60, a passageway 62 and a tube 64 into chamber 14 where it applies a force to the upper end of poppet valve 20, whereby the latter is urged to assume the position shown in FIG. 1 wherein a rubber disc 66 attached to its underside makes a tight seal with the upper end of cylinder 22. Simultaneously air is supplied by a passageway 68 to an air reservoir chamber 70 surrounding cylinder 22 and proceeds through an orifice 72 of safety valve 32 to urge its valve member 36 down so as to close off an opening defined by a valve seat 74 leading to one or more vent ports 76 that communicate with a vent opening 78 in the upper end of nozzle 10. As a consequence, the air entering the chamber of safety valve 32 also passes through a side port 80 and a passageway 82 into the interior of cylinder 22, thereby providing a force on the underside of piston 26 which holds the piston up against the sealing disc 66 of poppet valve member 20. Any air trapped between the upper end of the piston 26 and the disc 66 is exhausted to the atmosphere via a passageway 84 in poppet valve 20 and a port 86 formed in cap 8. At this point the device is in a neutral, pressurized state.

Nozzle 10 pivotally supports two mutually engaging lever arms 88 and 90 and also has a bore 92 in which a safety rod 94 is slidably disposed. Rod 94 engages lever 88, and lever 90 engages actuating rod 40 attached to valve head 36.

In order for the tool to fire, safety actuator rod 94 must be forced upwardly far enough to cause levers 88 and 90 to pivot so as to force rod 40 to lift valve member 36 sufficiently to unblock the opening in valve seat 74. If the trigger 42 should be squeezed while rod 94 is in the down position shown in FIG. 1, valve member 34 will change positions and the air pressure acting on the upper side of the poppet valve 20 will be released by a discharge of air from chamber 14 via tube 64, the chamber in which valve member 34 is disposed, and valve port 58. As a result, the pressure in reservoir 70 will then move poppet valve 20 up and thereby allow pressurized air from the reservoir to act on the upper end of piston 26. No movement of the piston will occur at this point, however, because an equilibrium force condition exists as a result of the opposing force of the pressurized air acting on the bottom surface of piston 26 and the additional static frictional forces due to the engagement of piston seal 96 with the cylinder 22, and the engagement of rod-like hammer 28 with a stationary seal 98 carried by end wall 24.

However, if safety actuator rod 94 is pushed far enough upwards so as to cause valve member 36 to block off orifice 72, the air pressure acting on the underside of piston 26 will be rapidly exhausted to the atmosphere by outflow of air via passageway 82, side port 80, port 76 and opening 78. Hence, if the trigger 42 should be squeezed so as to move the valve member 34 up far enough to close off orifice 54 while safety actuator rod 94 is held in its upward position, poppet valve 20 will move up rapidly in chamber 14 and the full line pressure in reservoir 70 will act on the upper end of piston 26 to cause the latter to move rapidly through its normal firing stroke so as to engage hammer 28 with a fastener 50 advanced by magazine 4 and thereby drive it from the nozzle into a workpiece. The piston 26 will not return to its normal starting position (FIG. 1) until the actuator rod 94 and trigger 42 are both released. Then the driver will be ready to fire again, a new fastener having been automatically loaded into the firing chamber, i.e., travelway 48, by the fastener magazine 4. In the preferred embodiment described and illustrated herein the safety actuator rod 94 is adapted to yield under about 15 pounds of pressure.

Figure 2:
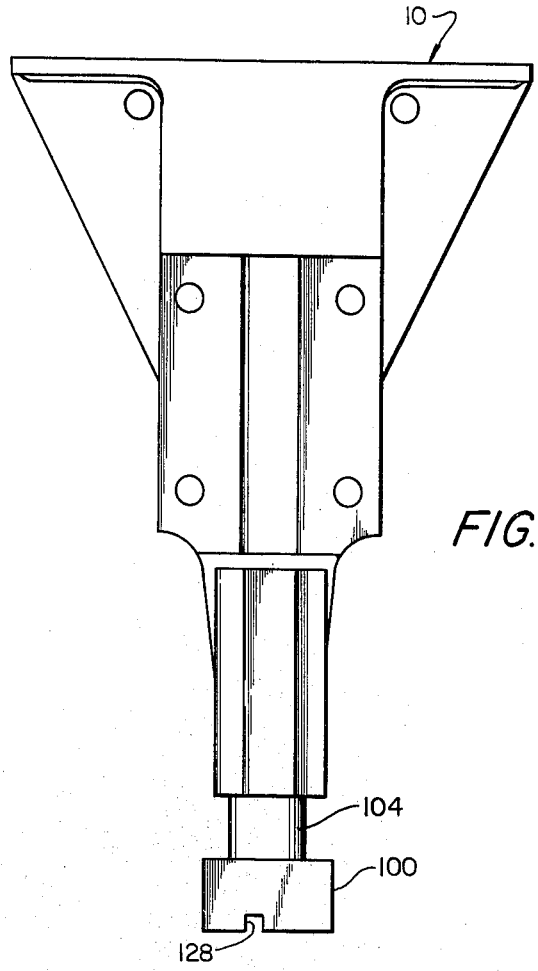
FIG. 2 is an enlarged rear view of the driver nozzle and the centering block.
Figure 3:
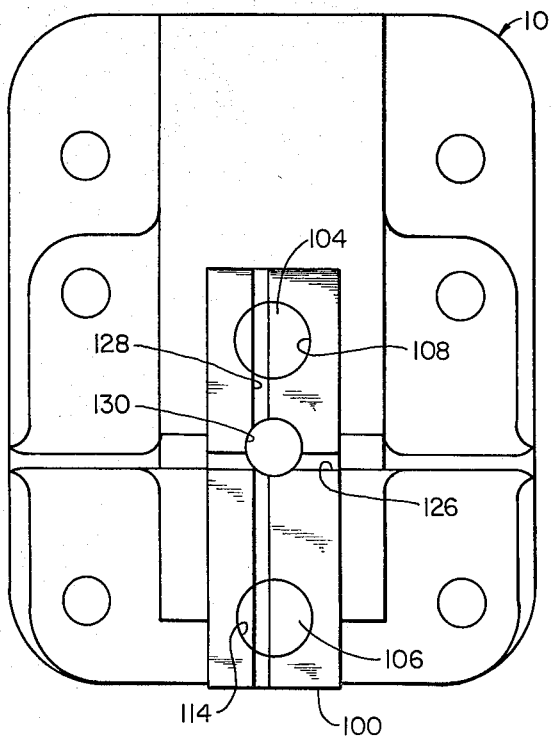
FIG. 3 is an enlarged bottom view of the fastening tool.

Looking next at FIGS. 1-3, there is shown the nozzle 10 and centering block 100. Centering block 100 is supported adjacent the end of nozzle 10 by means of two rods 104 and 106. Block 100 extends in front of the front or outer end of rod 94. Nozzle 10, rods 104 and 106, and centering block 100 are constructed so as to allow block 100 to reciprocate relative to nozzle 10. To this end, one end of rod 104 is disposed in a bore 108 which runs through centering block 100. A pin 110 secures rod 104 to block 100. The other end of rod 104 is disposed in a bore 112 in nozzle 10. Rod 104 makes a close sliding fit with bore 112. Similarly, one end of rod 106 is disposed in a bore 114 running through block 100. Rod 106 is locked to block 100 via a pin 116. The other end of rod 106 makes a close sliding fit with a bore 118 in nozzle 10, and has an elongated slot 120 near its upper end. A pin 122 extends through slot 120 and is anchored in nozzle 10, so that the reciprocal movement of rod 106 relative to nozzle 10 is limited by pin 122 and slot 120. Slot 120 is arranged so that block 100 can be retracted towards the end of nozzle 10 so as to touch or almost touch nozzle 10 but at least sufficiently to force safety rod 94 so as to cause levers 88 and 90 to arm the driver. Slot 120 also is sized so that block 100 can move sufficiently far from the nozzle to allow safety rod 94 to shift enough to allow levers 88 and 90 to return to the safety position shown in FIG. 1. A spring 124 in the inner end of bore 118 yieldably urges rod 106 (and hence block 100) away from housing 6 of the fastener driver.

The outer face of centering block 100 is flat but has a pair of grooves 126 and 128. Grooves 126 and 128 intersect one another at a right angle and also intersect a bore 130 which extends through block 100. Grooves 126 and 128 have a square cross-section, but grooves with semi-circular or rectangular cross-sections may also be used, depending upon the cross-sectional shape of the wires making up the lath. Bore 130 is aligned with hammer travelway 48 so as to enable a fastener fired by driver 2 to reach a workpiece. Bore 130 is disposed off-center the intersection of grooves 126 and 128 in order that when a wire intersection of a lath is fitted into grooves 126 and 128, and a fastener fired, the fastener will be set sufficiently close to the wire intersection so as to catch the intersection with the head of the fastener while just missing it with the shank of the fastener. In this way centering block 100, in conjunction with its resident grooves 126 and 128, can serve to center the fastening tool about a wire intersection of a wire and paper lath.

Figure 4:
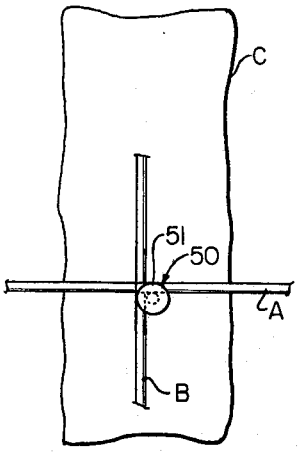
FIG. 4 illustrates how a wire lath is secured with a fastener using the present invention.

The fastening tool is intended to be used as follows. First an operator brings the wire and paper lath up against the structural members (i.e. the studs, furring strips or joists) to which the lath is to be attached. Then the operator brings the block 100 of the fastening tool up against a portion of the lath overlying one of the structural members so that a wire intersection is captivated in the grooves 126 and 128. Next the operator forces the tool against the structural member, so that the lath is held firmly against the structural member while block 100 is forced back towards housing 6. This causes safety rod 94 to retract into nozzle 10 so as to arm the tool. Then, when an operator pulls trigger 42, a fastener 50 will exit hammer travelway 48 and pass through bore 130 so as to fix the wire intersection to the structural member. FIG. 4 illustrates how two intersecting wires A and B of a wire lath are secured by the head 51 of fastener 50 to a structural member C.

Of course, it is also possible to utilize the preferred embodiment of the present invention in such a way that each fastener secures only one wire of the lath to a structural member, instead of two intersecting wires as described above. In this case the tool is placed up against the lath (and structural member) between adjacent wire intersections so that only one of the grooves 126 or 128 is in engagement with a wire of the lath. Then when a fastener is set by the tool, the head of the fastener will captivate only one wire of the lath to the structural member. Of course, it will be appreciated that it is generally more preferable to utilize the preferred embodiment of the present tool to captivate two intersecting wires of the lath with each fastener, since it generally results in superior attachment of the lath to the structural members.

MODIFICATIONS OF THE PREFERRED EMBODIMENT

Of course, it is possible to modify the preferred embodiment of the fastening tool without departing from the present invention.

Thus, for example, the safety rod 94 and block 100 could be arranged so that rod 94 is activated by engagement with the work surface rather than by movement of block 100. Alternatively, one might provide a fastening tool where the centering grooves would be disposed directly on the exit nozzle of the fastening tool. Such an arrangement would require an enlarged exit nozzle in order to assure stable footing of the tool on the lath, but it would eliminate the need for a centering block on the fastening tool. In such an embodiment safety rod 94 could contact the lath and structural member directly, or a totally different driver could be employed which utilizes no such safety rod mechanism.

Alternatively, one might provide a fastening tool which incorporates a centering block of the type shown in the preferred embodiment, but where the centering block 100 does not reciprocate relative to the nozzle. Instead, the centering block could be fixed in position relative to nozzle 10, and safety rod 94 would pass through a bore in the block or around the block so that it could be activated by direct contact with the lath and structural member. Alternatively, the fastening tool could use a fixed centering block design of the type just described with a driver which does not use a safety rod mechanism at all.

It is also envisioned that one might provide a fastening tool similar to the preferred embodiment except that the tool would have a more or less than the two support rods 104, 106 shown, i.e. the tool could have one or three support rods for coupling the centering block to the nail driver.

Furthermore, one might provide a fastening tool which has only one of the two grooves 126, 128 on its front, if only one wire of the lath is to be engaged by each fastener instead of two intersecting wires. However, as noted above, it is generally more preferable to have each fastener engage two wires of the lath at their intersections instead of simply one wire, so that this embodiment of the invention is less desirable than the preferred embodiment described above.

Still other modifications will be obvious to one skilled in the art and are considered within the scope of the present invention.

ADVANTAGES OF THE PRESENT INVENTION

There are numerous advantages to be gained by practicing the present invention.

First, the fastening tool provides a way of facilitating the attachment of wire and paper lath to structural members such as studding, furring strips, or joists. The present tool allows fasteners of either the standard nail or threaded pin type to be set several times faster than one can hand set nails, and up to five times as fast as one can hand set threaded pins.

Second, the fastening tool will fasten the wire and paper lath to structural members by captivating the lath's wire intersections between the head of a fastener and the structural member.

Third, the fastening tool includes means thereon for quickly and easily centering the tool about one of the wire intersections of the wire and paper lath, in order that the fastening tool can consistently capture that intersection between the head of the fastener and the structural member receiving the fastener.

Fourth, the fastening tool uses a reliable pneumatic driver of the type shown in U.S. Pat. No. 4,040,554.

And fifth, the fastening tool is light in weight, low in cost, fast in operation, and effective in practice. An important factor in its effectiveness is the size of the block 100, which can be made large enough to render the tool stable and position it perpendicular to the work surface, yet be small enough to allow it to apply fasteners at any selected point along the length and breadth of the lath.

Still other advantages of using the present invention will be obvious to one skilled in the art.

What I claim is:

1. A fastening tool for attaching wire lath to a structural support member with a fastener of the type having a shank and a head, said tool comprising a fastener driver and a centering block;

said fastener driver comprising (1) a nozzle having an end surface and an internal hammer travelway terminating in an opening in said end surface, (2) a hammer movably disposed within said hammer travelway, and (3) operating means for causing said hammer to move through a drive stroke and a return stroke along said travelway so that a fastener positioned in said travelway can be driven from said nozzle via said opening by said hammer; and said centering block comprising a front face and a rear face, with said centering block being positioned in front of said end surface so that said front face faces away from said end surface and said rear face faces towards said end surface, said centering block having a bore extending between said front and rear faces, said bore being in axial alignment with said end surface opening and being sized to pass a fastener discharged from said end surface opening by said hammer;

said centering block also having at least one groove formed in said front face, said at least one groove being positioned on said front face eccentric to the center axis of said bore so that when said tool is brought up against a portion of a wire lath and positioned so that said at least one groove receives at least one wire of said lath and captivates said at least one wire against a support member, the shank of a fastener fired from said fastener driver will pass alongside said at least one wire into said support member and the head of said fastener will anchor said at least one wire of said lath to said support member.

2. A fastening tool according to claim 1 wherein said centering block has two intersecting grooves formed in said front face, said two intersecting grooves being positioned on said front face eccentric to the axis of said bore.

3. A fastening tool according to claim 2 wherein said fastener driver further comprises safety means for preventing said operating means from causing said hammer to move through said drive stroke until said safety means is operated, said safety means comprising an actuating member in said nozzle arranged to release said safety means when said actuating member is moved inward relative to said end surface of said nozzle.

4. A fastening tool according to claim 3 wherein said centering block is movably mounted to said fastener driver so as to be able to reciprocate between inner and outer positions relative to said fastener driver, and further wherein said centering block is yieldably biased towards its said outer position, with said centering block being arranged to move said actuating member so as to release said safety means.

5. A fastening tool according to claim 4 wherein said centering mechanism comprises at least one support rod slidably coupling said centering block to said fastener driver.

6. A fastening tool according to claim 5 further including a spring for yieldably urging said centering block away from said nozzle.

7. A fastening tool according to claim 6 wherein said at least one support rod includes a slot intermediate its two ends, and further including a pin anchored in said nozzle and extending through said slot so as to limit the movement of said at least one support rod relative to said nozzle.

8. A fastening tool for attaching a wire lath to a structural support member with a fastener of the type having a shank and a head, said tool comprising a fastener driver and centering means coupled to said fastener driver, wherein:

said fastener driver comprises (1) a nozzle having an end surface and an internal hammer travelway terminating in an opening in said end surface, (2) means including a side opening in said nozzle for positioning a fastener in said hammer travelway, (3) a hammer movably disposed within said hammer travelway, and (4) operating means for causing said hammer to move through a drive stroke and a return stroke along said travelway so that said hammer can drive a fastener out of said travelway via said opening in said end surface; and said centering means comprises a pair of grooves formed in an end surface of said nozzle, said grooves being positioned on said end surface eccentric to the center axis of said opening so that when said tool is brought up against a portion of a wire lath so that at least one of said grooves receives a wire of said lath and captivates said wire against a support member, the shank of a fastener fired from said fastener driver will pass alongside said wire into said support member and the head of said fastener will captivate said wire lath to said support member.

* * * * *